US006748966B1

(12) United States Patent
Dvorak

(10) Patent No.: US 6,748,966 B1
(45) Date of Patent: Jun. 15, 2004

(54) COMBINATION AIR GAP FOR DISH WASHER AND SOAP DISPENSER

(76) Inventor: Steven G. Dvorak, 8400 Hempstead Rd., Houston, TX (US) 77008

( * ) Notice: Subject to any disclaimer, the term of this patent is extended or adjusted under 35 U.S.C. 154(b) by 58 days.

(21) Appl. No.: 10/231,931

(22) Filed: Aug. 30, 2002

Related U.S. Application Data

(60) Provisional application No. 60/317,047, filed on Sep. 4, 2001.

(51) Int. Cl.[7] ..... F16K 24/04
(52) U.S. Cl. ..... 137/216; 222/321.7
(58) Field of Search ..... 137/216; 222/321.1, 222/321.3, 321.7

(56) References Cited

U.S. PATENT DOCUMENTS 4,911,335 A 3/1990 Stofle et al.
5,713,385 A 2/1998 Traylor

*Primary Examiner*—Gerald A. Michalsky
(74) *Attorney, Agent, or Firm*—Law Office of Tim Cook P.C.

(57) ABSTRACT

A structure is mounted on a sink top or counter top between a dishwasher discharge line and a vented plumbing line to provide an anti-siphon feature for a household dishwashing machine. The structure also includes in combination a pump-type soap dispenser. The pump-type soap dispenser includes a push-actuated pump to pump liquid soap from a reservoir bottle, and the pump slides into and out of a mounting collar for ease of removal to facilitate refilling the reservoir bottle.

9 Claims, 2 Drawing Sheets

FIG. 1
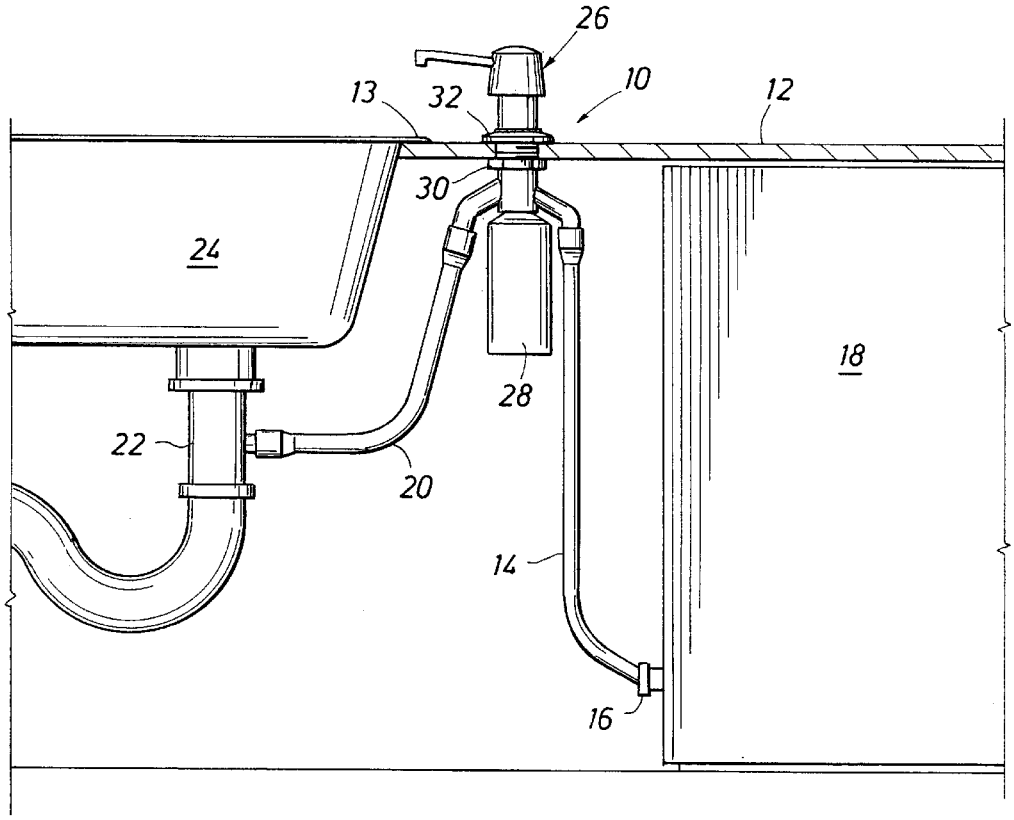
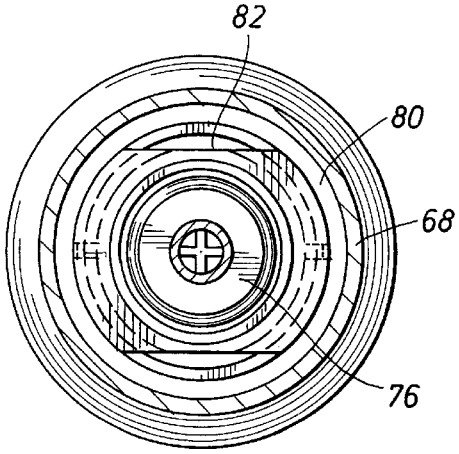
FIG. 3
FIG. 4
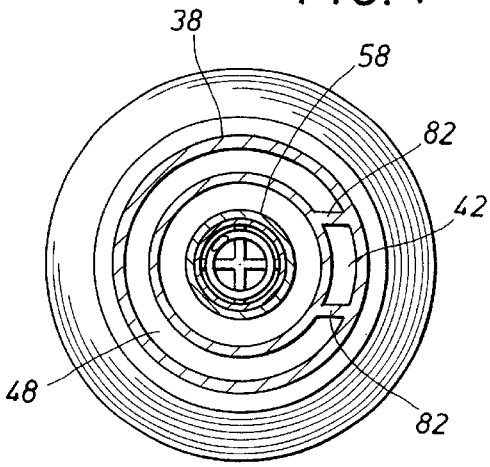

COMBINATION AIR GAP FOR DISH WASHER AND SOAP DISPENSER

This application claims the benefit of Provisional Application Ser. No. 60/317,047 filed Sep. 4, 2001.

FIELD OF THE INVENTION

The present invention relates generally to the field of household dishwashers and, more particularly, to an air gap structure for such a dishwasher in combination with a liquid soap dispenser.

BACKGROUND OF THE INVENTION

Modem plumbing codes typically specify that an anti-siphon or air gap must be located between a household dishwasher outlet hose and the sewage drain line. If a garbage disposer exists, the air gap must be located between the dishwasher outlet hose and the garbage disposer. This prevents development of a vacuum in the lines which could cause drain or waste water to be siphoned back into the dishwasher and into the water supply upstream of the dishwasher. The structure and explanation of such a system is shown and described in U.S. Pat. No. 5,713,385, incorporated herein by reference.

The body of the typical dishwasher air gap extends above the top of the sink or the kitchen counter next to the sink. It includes one or more air gap openings providing communication between the environment and a chamber within the air gap body through which the dishwasher water flows. The dishwasher outlet hose is connected to an air gap inlet conduit of the air gap body. This inlet conduit terminates adjacent the vent chamber of the air gap body so that the stream of dishwasher waste water passing through the chamber is vented to atmosphere.

A typical dishwasher air gap retrofit apparatus is sold by LDR Industries, Inc. Unfortunately, the air gap apparatus extends above the sink or counter top and often has no other useful apparent function. The same company, LDR Industries, Inc., also sells a soap dispenser which is adapted to me mounted in an opening at a sink top or counter top, but is not adapted to be fit together with the air gap apparatus.

Thus, there remains a need for a liquid soap dispenser that is adapted to be mounted in combination with an air gap apparatus in order to eliminate the unsightly air gap extension above the counter top or sink top. The present invention solves that need in the art.

SUMMARY OF THE INVENTION

The present invention comprises a structure mounted on a sink top or counter top between a dishwasher discharge line and a vented plumbing line to provide the anti-siphon feature previously described, in combination with a pump-type soap dispenser. The pump-type soap dispenser includes a push-actuated pump to pump liquid soap from a reservoir bottle, and the pump slides into and out of a mounting collar for ease of removal to facilitate refilling the reservoir bottle. The liquid soap may comprise hand-washing soap, dish-washing soap, or any other appropriate liquid soap or lotion useful at a sink.

These and other features and advantages of the invention will be apparent to those of skill in the art from a review of the following detailed description along with the accompanying drawings.

BRIEF DESCRIPTION OF THE DRAWINGS

FIG. 1 is a elevation drawings of the combination air gap and soap dispenser of the present invention, installed in a plumbing system.

FIG. 3 is a top section view of the apparatus, taken along lines 3—3 of FIG. 2.

FIG. 4 is a top section view of the apparatus, taken along lines 4—4 of FIG. 2.

DETAILED DESCRIPTION OF A PREFERRED EMBODIMENT

Figure 2:
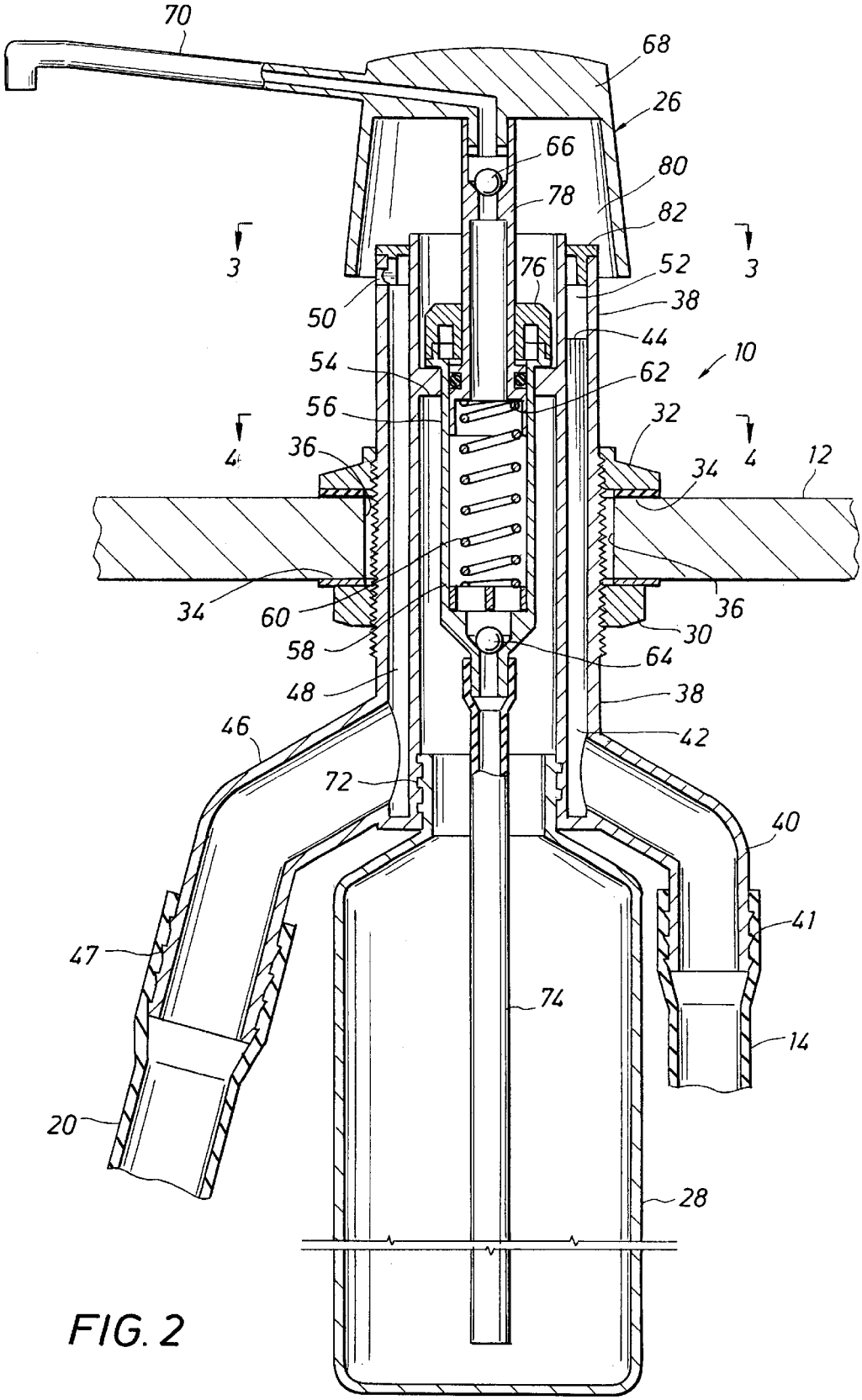
FIG. 2 is a side section view of the structure of the invention.

Referring first to FIG. 1, a combination air gap and soap dispenser 10 of the invention is depicted. The air gap/dispenser 10 is rigidly mounted to a counter top 12, although it may as easily be mounted to a sink top 13 if convenient. A hose 14 couples a discharge line 16 of a dishwasher 18 and the air gap/dispenser 10. A hose 20 also couples a plumbing line 22 from a sink 24 to the air gap/dispenser 10. The plumbing line 22 is open to the atmosphere.

The air gap/dispenser 10 includes a hand-actuated pump 26 above the counter top 12 and a reservoir bottle 28 below the counter top 12. The air gap/dispenser 10 is held firmly in place with a screw-type washer 30 below the counter top and a screw-type washer 32 above the counter top, all of which is shown in greater detail in FIG. 2.

As shown in FIG. 2, the air gap/dispenser 10 mounts to the counter top 12 with a threaded washer 30 under the counter top 12 and a threaded washer 32 above the counter top. A gasket 34 is preferably mounted between each of the washers 30 and 32 and the counter top 12 to provide a seal around a hole 36 in the counter top 12 through which the air gap/dispenser penetrates.

The threaded washers 30 and 32 thread onto a body 38 which fits up through the hole 36 from below the counter top 12 when installing the device. At the bottom of the body 38 is a stub coupling 40 which attaches to the hose 14 (FIG. 1). The stub coupling 40 may be joined to the hose 14 with a well-known serrated coupling 41 or similar attaching means. The stub coupling 40 communicates with a vent pipe 42 which extends upward inside the body 38 to the level of a shoulder 44. At the bottom of the body 38 is another stub coupling 46 which attaches to the hose 20 (FIG. 1) with a serrated coupling 47 or the like. The stub coupling 46 communicates with an annular vent space 48 which extends upward inside the body 38 to the level of a vent hole 50. The vent pipe 42 and the vent space 48 communicate with each other at an annular space 52 above the level of the shoulder 44 and below the level of the vent hole 50. This will be shown and described below with regard to FIGS. 3 and 4.

The body 38 includes a laterally inwardly extending flange 54 on the interior surface of the body. The flange 54 supports the weight of a pump mechanism 56 which lifts freely out of the body 38. Alternatively, the pump mechanism may be reversibly secured to the shoulder as with a bayonet mount or the like. The pump mechanism 56 comprises primarily a cylindrical spring housing 58 which encloses a spring 60. The spring rests on the bottom of the housing 58 and is constrained by a barrier 62 at the top of the housing 58. The spring maintains the pump mechanism in a quiescent position ready to pump fluid from the reservoir.

At the bottom of the housing 58 and below the level of the bottom of the spring is a first check valve 64. A second check valve 66 seals off above the spring housing. Pressing down on a cap 68 unseats the first and second check valves and dispenses fluid out of a spout 70 in the conventional manner.

Fluid is retained in the reservoir bottle 28 which couples to the body 38 at a set of threads 72. A dispensing tube 74 extends down into the reservoir bottle 28 into fluid retained in the bottle 28. By force of the action of the pump, fluid is pumped out of the bottle 28, up the tube 74, and through the first and second check valves.

Referring briefly to FIGS. 3 and 4, the top section views taken along section lines 3—3 and 4—4 are depicted. As shown in FIGS. 2 and 3, a retainer sleeve 76 fits around and retains a discharge tube 78 (See FIG. 2) to complete the arrangement with the spring housing 56. The discharge tube 78 is coupled to the underside of the cap 68, and so pulling up on the cap also pulls up the spring housing and the tube 74, leaving a large opening so that the reservoir bottle can be easily refilled. The underside of the cap 68 comprises a frustoconical chamber 80 to provide clearance between the cap and the pump mechanism beneath it. An alignment cap 82 is also provided to provide lateral rigidity to the body while sealing off the top of the vent 42 from inadvertent discharge of fluid up the vent.

FIG. 4 more clearly shows the relation between the vent pipe 42 and the annular vent space 48. The vent 42 and the vent space 48 are both formed by inner and outer walls of the body 38 but are separated by a pair of laterally extending vertical walls 82.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A siphon-breaking air gap device for a dishwasher comprising:

a. a vertically disposed cylindrical body adapted to penetrate a counter top;

b. a first stub tube extending from the body and adapted to couple the body to a discharge line on the dishwasher;

c. a second stub tube extending from the body and adapted to couple the body to a plumbing line open to the atmosphere;

d. a reservoir bottle coupled to the body and adapted to contain a quantity of a liquid soap; and e. a pump mounted to the body and having a tube extending into the bottle to dispense liquid soap from the bottle.

2. The air gap device of claim 1, further comprising a shoulder within the body.

3. The air gap device of claim 2, further comprising a vertically extending vent pipe within the body communicating between the first stub tube to the shoulder.

4. The air gap device of claim 3, further comprising a vent hole through the body.

5. The air gap device of claim 4, further comprising a vent space within the body communicating between the second stub tube and the vent hole.

6. The air gap device of claim 5, wherein the vent hole is vertically positioned above the shoulder.

7. The air gap device of claim 1, further comprising a radially inwardly extending flange adapted to support the weight of the pump.

8. The air gap device of claim 1, wherein the pump comprises a pair of check valves in a vertically spaced apart relation and a spring to maintain the pump is a quiescent position.

9. The air gap device of claim 1, further comprising a threaded coupling between the reservoir bottle and the body.

* * * * *